US006397866B1

(12) United States Patent
You

(10) Patent No.: US 6,397,866 B1
(45) Date of Patent: Jun. 4, 2002

(54) FOR SPRING MECHANISM FOR LARGE UMBRELLA WITH AUTOMATIC OPEN FEATURE

(76) Inventor: Ching-Chuan You, 5F., No. 144, Ming Chuan E. Rd., Sec. 3, Taipei (TW)

( * ) Notice: Subject to any disclaimer, the term of this patent is extended or adjusted under 35 U.S.C. 154(b) by 22 days.

(21) Appl. No.: 09/707,990

(22) Filed: Nov. 8, 2000

(51) Int. Cl.[7] ..... A45B 25/14

(52) U.S. Cl. ..... 135/23; 135/20.3; 135/22; 135/29; 135/30; 135/31; 135/32

(58) Field of Search ..... 135/29–32, 16, 135/19.5, 20.3, 22, 23

(56) References Cited

U.S. PATENT DOCUMENTS 5,121,764 A * 6/1992 Wu ..... 135/31
5,226,438 A * 7/1993 Dubinsky ..... 135/33.4
5,267,583 A * 12/1993 Wu ..... 135/24
5,626,160 A * 5/1997 Ko ..... 135/22
6,016,822 A * 1/2000 Lin ..... 135/24
6,164,303 A * 12/2000 Lin ..... 135/29
6,167,894 B1 * 1/2001 Lin ..... 135/15.1
6,332,472 B1 * 12/2001 Kuo ..... 135/23

* cited by examiner

*Primary Examiner*—Beth A. Stephan

(57) ABSTRACT

An auxiliary elastic support mechanism for a large umbrella with automatic open feature is provided. The umbrella is supported by a plurality of ribs and a plurality of spreaders. The mechanism comprises a plurality of rib joint members each put on the rib having a pivot joint and a first spring anchoring lug; a plurality of spreader joint members, each having an outer end secured to one of the rib joint members, an inner end for receiving the spreader therein, and a second spring anchoring lug; and a plurality of auxiliary springs each having an outer hook engaged with the first spring anchoring lug and an inner hook engaged with the second spring anchoring lug.

3 Claims, 5 Drawing Sheets

FOR SPRING MECHANISM FOR LARGE UMBRELLA WITH AUTOMATIC OPEN FEATURE

BACKGROUND OF THE INVENTION

1. Field of the Invention

The present invention relates to umbrellas and more particularly to an improved spring mechanism for large umbrella so as to provide an optimal expansible force while automatically opening the umbrella.

2. Description of Related Art

Conventionally, a large umbrella means an umbrella having a large canopy (i.e., large covering area). Accordingly, the thickness of canopy is increased, the frame is made large and its weight is increased. With this, the large umbrella may withstand a strong force exerted thereon by wind. But inevitably a user may have to exert a great force to open the large umbrella.

An improvement to above conventional large umbrella is to mount a spring between upper ring and lower ring. In a closed condition, spring is compressed to store an elastically energized force therein. When locking tab is deactivated, spring is automatically expanded to provide a main expansible force for opening the umbrella.

But this is still unsatisfactory for the purpose for which the invention is concerned for the following reasons:

1. The automatic opening mechanism is effected by a well chosen spring. However, there are many other factors (e.g., the joints between ribs and spreaders, the folded canopy sectors, or the like) consumed the elastic force of spring. As such, an ideal spring is not easy to find.
2. A spring with stronger elastic force than the optimum may exert an excessive upward force which may neutralize the elastic hub provided at the upper end of shank in a short period of time of use, thus shortening the useful life of umbrella. Also, the operation is labor consuming and much inconvenient.
3. A spring with weaker elastic force than the optimum may not exert a sufficient upward force to open the umbrella. As such, an additional manual force must be exerted to open the umbrella.

SUMMARY OF THE INVENTION

It is an object of the present invention to provide a spring mechanism for a large umbrella with automatic open feature wherein the spring mechanism is optimized such that a variety of advantages such as smooth operation; less labor consuming, reliable, and prolonged useful time are obtained.

To achieve the above and other objects, the present invention provides an auxiliary elastic support mechanism for a large umbrella with automatic open feature, the umbrella being supported by a plurality of ribs and a plurality of spreaders, the mechanism comprising a plurality of hollow cylindrical rib joint members each put on the rib having a pivot joint and a first spring anchoring lug; a plurality of hollow cylindrical spreader joint members, each having an outer end secured to one of the rib joint members, an inner end for receiving the spreader therein, and a second spring anchoring lug; and a plurality of auxiliary springs each having an outer hook engaged with the first spring anchoring lug and an inner hook engaged with the second spring anchoring lug.

The above and other objects, features and advantages of the present invention will become apparent from the following detailed description taken with the accompanying drawings.

DETAILED DESCRIPTION OF THE PREFERRED EMBODIMENTS

Figure 1:
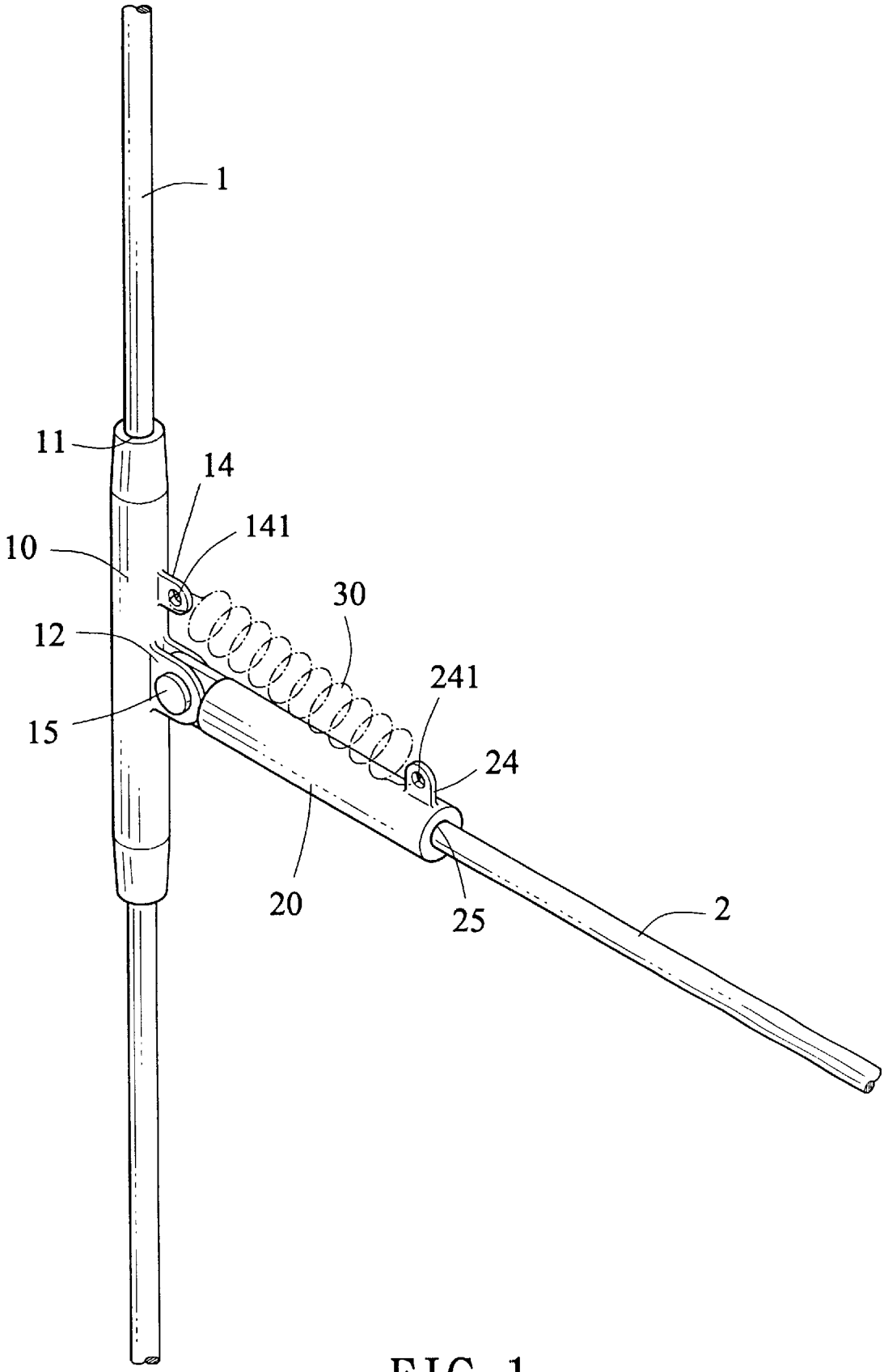
FIG. 1 is a perspective view of an auxiliary spring for a large umbrella with automatic open feature according to the invention.
Figure 2:
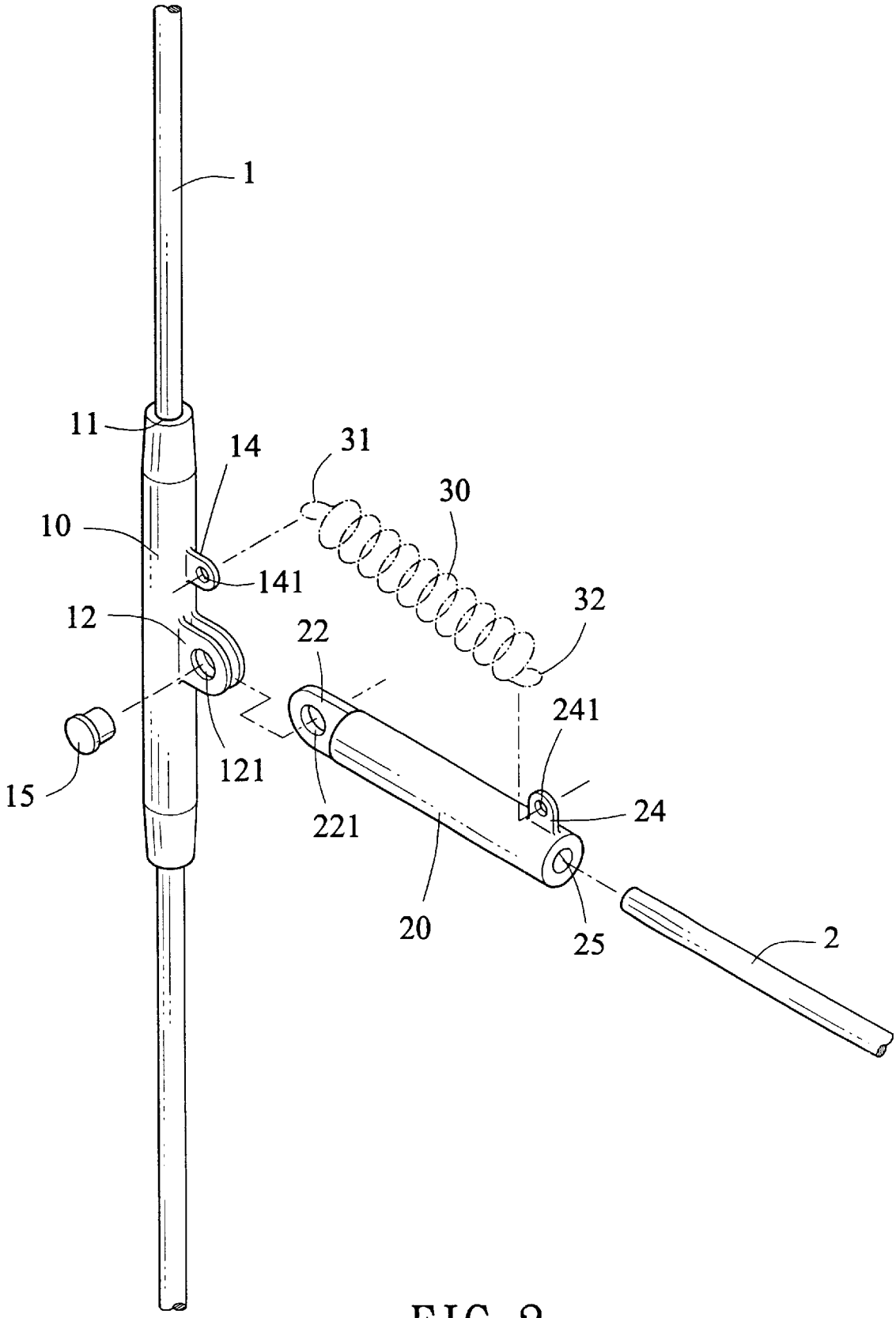
FIG. 2 is an exploded view of the FIG. 1 device.

Referring to FIGS. 1 and 2, there is shown an auxiliary spring 30 and associated components for a large umbrella with automatic open feature. Each component as well as auxiliary spring 30 itself will now be described in detail. Rib joint member 10 is a tube member including an opening 11 for allowing rib 1 to pass through, a pivot joint 12 having a hole 121, and a spring anchoring lug 14 having a hole 141. Spreader joint member 20 is a hollow cylinder having an outer end 22 with a hole 221 such that a pin 15 may insert through the holes 121 and 221 to pivotably secure rib joint member 10 to spreader joint member 20. Spreader joint member 20 further comprises an upper spring anchoring lug 24 having a hole 241 at the inner end and an opening 25 for closely receiving spreader 2 therein. Auxiliary spring 30 has an outer hook 31 engaged with hole 141 of spring anchoring lug 14 and an inner hook 32 engaged with hole 241 of spring anchoring lug 24. This completes an auxiliary spring mechanism for providing an auxiliary expansible force to the open ribs 1 and spreaders 2.

Figure 3:
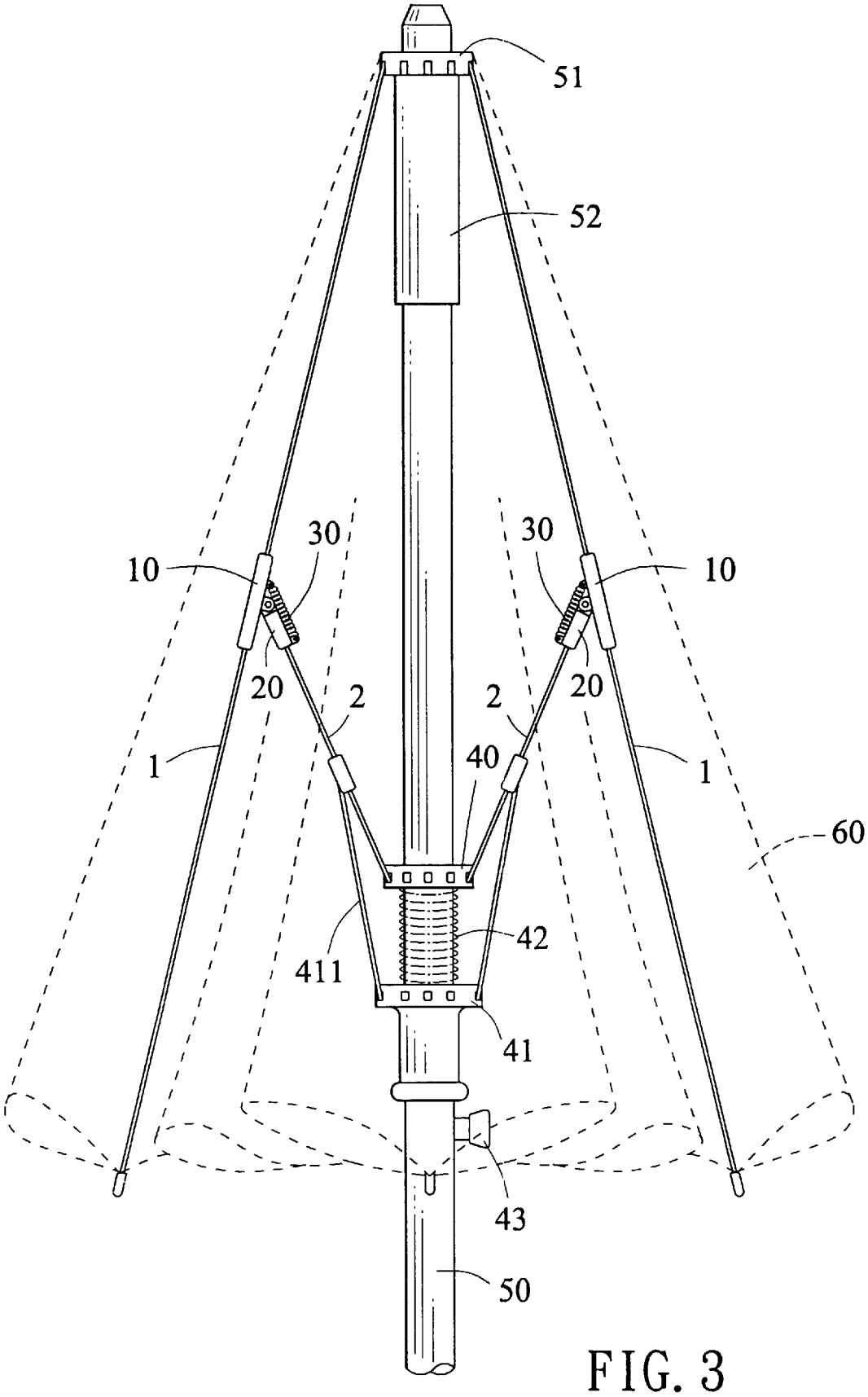
FIG. 3 is a schematic side view of a large umbrella in a closed condition incorporating the spring mechanism of the invention.

Referring to FIG. 3, it is seen that rib joint member 10 is put on rib 1, while spreader joint member 20 is attached to the outer end of spreader 2. Auxiliary spring 30 is anchored between rib joint member 10 and spreader joint member 20. An upper ring 40, a lower ring 41 and a main spring 42 are provided on shank 50 wherein main spring 42 is biased between upper ring 40 and lower ring 41. A locking tab 43 is provided on shank 50 below the lower ring 41 a predetermined distance. A ferrule 51 is at the topmost end of shank 50. A hub 52 is abutted below the ferrule 51. Also, canopy 60 is covered on ribs 1. A plurality of spreaders 2 are pivotably secured at inner ends to upper ring 40. A plurality of sub-spreaders 411 are pivotably secured between spreaders 2 and lower ring 41. Note that rib joint member 10, spreader joint member 20, spreaders 2, sub-spreaders 411, and auxiliary springs 30 all are the same in number.

Figure 4:
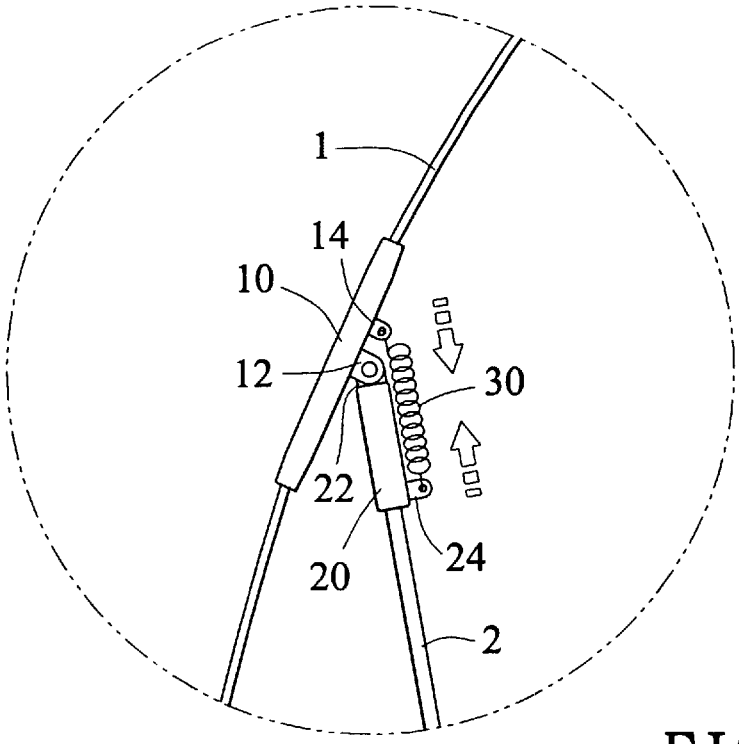
FIG. 4 is a greatly enlarged fragmentary view of the auxiliary spring in a closed condition of umbrella.

Referring to FIG. 4 in conjunction with FIG. 3, the closing of umbrella and the corresponding operation of auxiliary spring will now be described. In a closed condition lower ring 41 is locked by locking tab 43 and main spring 42 is compressed to store an elastically energized force therein. Further, the angle of spreader joint member 20 with respect to rib joint member 10 is gradually increased while closing the umbrella. At the same time, auxiliary spring 30 is expanded. As such, an elastically energized force is also stored in auxiliary spring 30.

Figure 5:
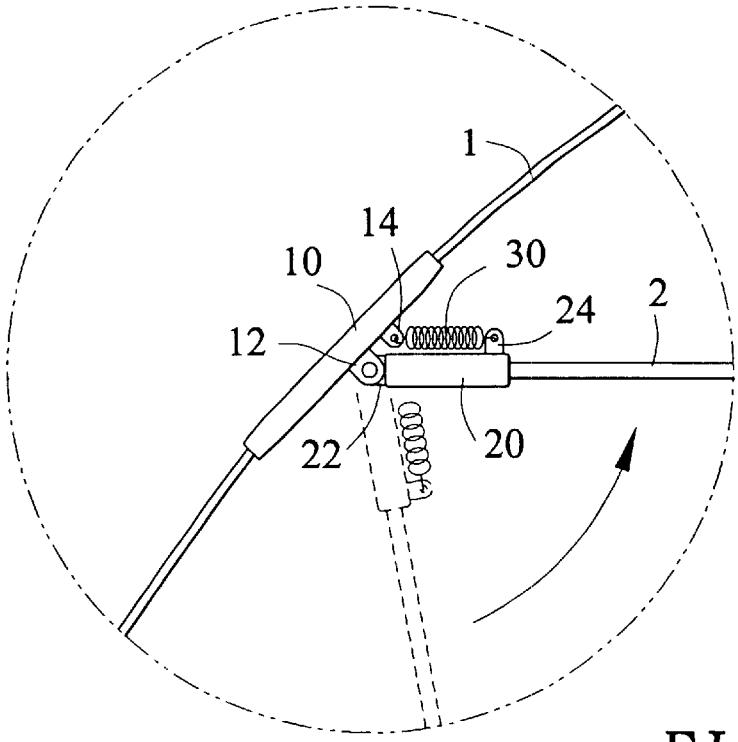
FIG. 5 is a view similar to FIG. 4 where the auxiliary spring being in an open condition of umbrella.

Referring to FIG. 5 in conjunction with FIG. 3, the opening of umbrella and the corresponding operation of auxiliary spring will now be described. When locking tab 43 is pressed, lower ring 41 is unlocked and main spring 42 is automatically expanded. Further, the angle of spreader joint member 20 with respect to rib joint member 10 is gradually decreased while opening the umbrella. At the same time, auxiliary spring 30 is compressed to cause spreader 2 to pivot counterclockwise about pivot joint 12. The combination effect of main spring 42 and auxiliary spring 30 can provide an expansible force for opening the umbrella.

Figure 6:
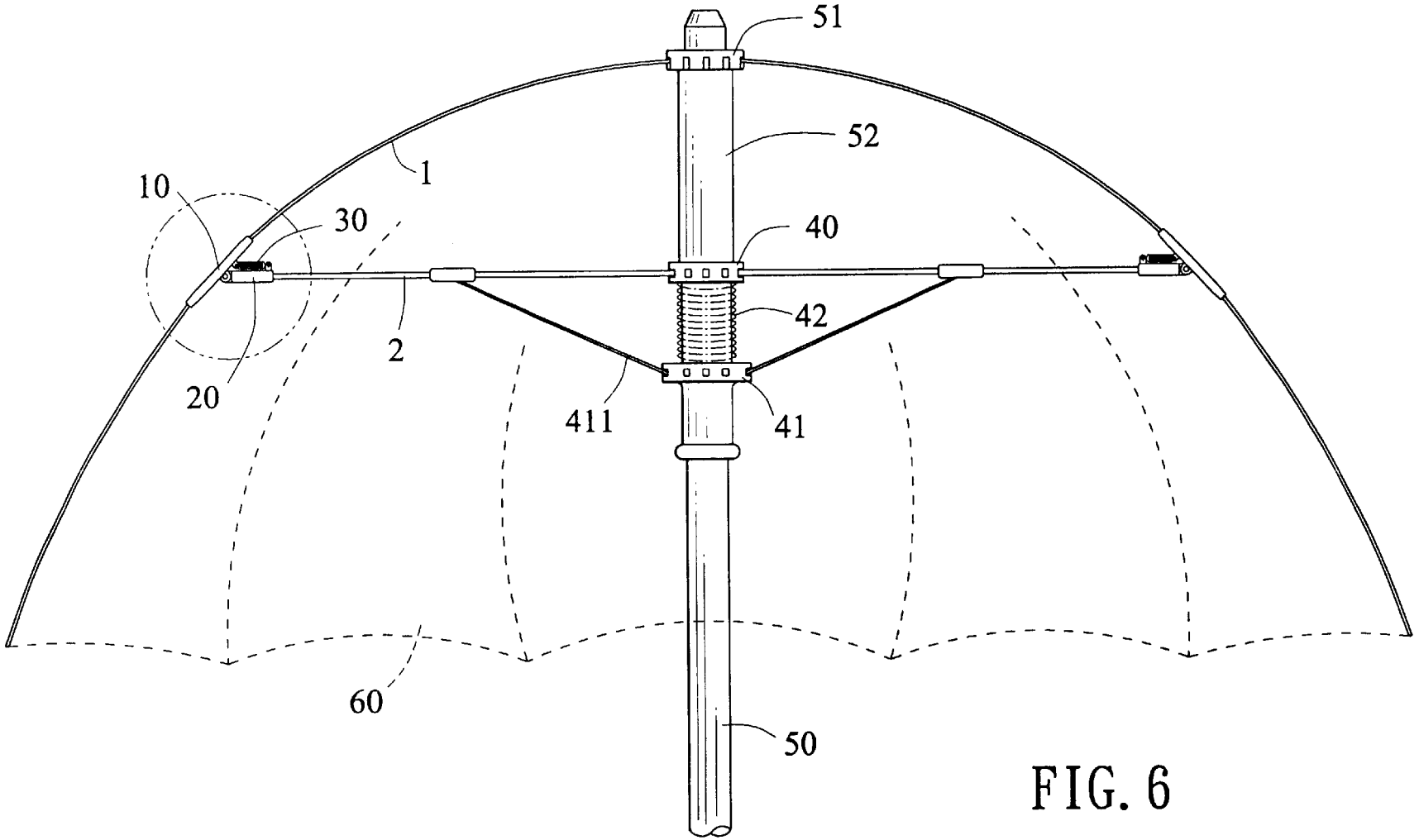
FIG. 6 is a schematic side view of a large umbrella in an open condition incorporating the spring mechanism of the invention.

Referring to FIG. 6, there is shown a large umbrella in an open condition incorporating the spring mechanism of the invention. It is important to note that both main spring 42 and a plurality of auxiliary springs 30 consist of the spring mechanism. In other words, the expansible force of umbrella is distributed to main spring 42 and the plurality of auxiliary springs 30. This facilitates the selection of main spring 42. Also, a variety of advantages such as smooth operation, less labor consuming, reliable, and prolonged useful time are obtained.

While the invention herein disclosed has been described by means of specific embodiments, numerous modifications and variations could be made thereto by those skilled in the art without departing from the scope and spirit of the invention set forth in the claims.

What is claimed is:

1. An auxiliary elastic support mechanism for an umbrella with automatic open feature, the umbrella being supported by a plurality of ribs and a plurality of spreaders, the mechanism comprising:

a plurality of rib joint members for receiving the ribs, each member having a pivot joint and a first spring anchoring lug;

a plurality of spreader joint members, each having an outer end secured to one of the rib joint members, an inner end for receiving the spreader therein, and a second spring anchoring lug; and a plurality of auxiliary springs each having an outer hook engaged with the first spring anchoring lug and an inner hook engaged with the second spring anchoring lug.

2. The auxiliary elastic support mechanism for an umbrella with automatic open feature as claimed in claim 1, wherein each rib is a round solid bar member and each rib joint member is a hollow cylindrical member.

3. The auxiliary elastic support mechanism for an umbrella with automatic open feature as claimed in claim 1, wherein each spreader is a round solid bar member and each spreader joint member is a hollow cylindrical member.

* * * * *